United States Patent [19]

Dworak et al.

[11] Patent Number: 4,465,444

[45] Date of Patent: Aug. 14, 1984

[54] REVERSIBLE GEAR MACHINE

[75] Inventors: Wilhelm Dworak, Stuttgart; Hayno Rustige, Oberrot; Günter Wolff, Schwieberdingen, all of Fed. Rep. of Germany

[73] Assignee: Robert Bosch GmbH, Stuttgart, Fed. Rep. of Germany

[21] Appl. No.: 425,002

[22] Filed: Sep. 27, 1982

[30] Foreign Application Priority Data

May 12, 1982 [DE] Fed. Rep. of Germany ..... 3217753

[51] Int. Cl.[3] ..... F03C 2/08; F04C 2/08; F04C 15/00

[52] U.S. Cl. ..... 418/132

[58] Field of Search ..... 418/131, 132, 135

[56] References Cited

U.S. PATENT DOCUMENTS

| | | | |
|---|---|---|---|
| 2,654,325 | 10/1953 | Minshall | 418/135 X |
| 2,866,416 | 12/1958 | Oliver | 418/132 |
| 3,270,680 | 9/1966 | Rich | 418/132 |
| 3,292,551 | 12/1966 | Gordon | 418/132 |
| 3,473,476 | 10/1969 | Davidson | 418/132 |
| 4,309,158 | 1/1982 | Grabow et al. | 418/132 |

FOREIGN PATENT DOCUMENTS

| | | | |
|---|---|---|---|
| 879023 | 11/1981 | U.S.S.R. | 418/132 |

*Primary Examiner*—John J. Vrablik
*Assistant Examiner*—Theodore Olds
*Attorney, Agent, or Firm*—Michael J. Striker

[57] ABSTRACT

A reversible gear machine which can be used either as a gear pump or as a gear motor regardless of the pressure gradient direction between its inlet and outlet ports includes a housing accommodating meshing gears for rotation about their respective axes which are defined by respective stub shafts extending axially beyond the end faces of the gears. At least one pressure element, which may be constituted by bearing members for the stub shafts, and which is movable axially of the respective stub shafts, has a surface facing away from the gears. A sealing component including a relatively rigid support ring and an elastically yieldable sealing body is accommodated in a groove of the sealing element provided at the aforementioned surface of the latter, such that the support ring contacts the close end wall of the housing and a rib of the sealing body contacts the bottom of the groove and subdivides the latter into two compartments. The sealing component delimits on the aforementioned surface of the sealing element first and second pressure fields which are in communication with the respective ports of the gear machine, and third pressure fields which are situated between the sealing component and the respective stub shafts and which are subjected to the pressure prevailing between the other axial surface of the pressing element inwardly of the root circle of the gear teeth and outwardly of the respective stub shafts. Two of the pressing elements and two of the sealing components may be provided, each at one axial side of the gears.

12 Claims, 12 Drawing Figures

60
56
61

56

60
47
62
61
VIII
VIII 55
53
54
56

49
46
51
50
IV
IV

REVERSIBLE GEAR MACHINE

BACKGROUND OF THE INVENTION

The present invention relates to gear machines in general, and more particularly to reversible gear machines which can be used as gear pumps or gear motors for either direction of flow of the operating fluid through the machine.

There are already known various constructions of gear machines of the above type, which generally include a housing bounding an internal chamber and two gears with external gear teeth annuli, these gears being so mounted on the housing and accomodated in the internal chamber that the gear teeth of the annuli mesh with one another during the operation of the gear machine while the gears revolve about their respective axes. The mounting is accomplished by bearing members which support stub shafts jointly rotatable with the gears and extending beyond the axial end faces of the same. The bearing members are usually substantially sleeveshaped and separate from the housing, being supported in the internal chamber of the housing for limited axial displacement toward and away from the gears. However, it is also possible to form the bearing members integral with the housing and especially with the end walls of the housing. In either event, it is necessary to assure that the interface between the respective end face of the gears and the element axially adjoining the same be sealed so as to avoid excessive leakage of the operating fluid through the interface between the high-pressure side and the low-pressure side of the gear machine. Thus, it has already been proposed to let the pressure of the operating fluid act either on the separate bearing members at the surface thereof facing away from the gears, so that such bearing members simultaneously constitute a pressing element, or to provide a separate pressing element at the respective axial side of the gears, and to let the pressure of the operating fluid act on the surface of the separate pressing element which faces away from the gears, to thereby displace the pressing element into sealing contact with the respective end face of the gears during the operation of the gear machine, thus keeping the size of the interface to a minimum regardless of the wear. Since it is also necessary to separate the high-pressure side from the low-pressure side of the gear machine even at the surface of the pressing element which faces away from the gears, it is customary to provide a substantially eyeglass-frame-shaped sealing component at this surface, especially to accommodate the same in a groove formed usually in the pressing element. This sealing component then delimits respective pressure fields at the aforementioned surface, these pressure fields being separated from one another by the sealing component and being respectively exposed to the pressure of the operating fluid derived from the high-pressure side and from the low-pressure side of the gear machine.

In one conventional construction of the gear machine incorporating the above-discussed structural features, the openings of the bearing members in which the shafts of the gears are rotatably supported are connected with one another at the regions of the sealing components. This construction of the sealing components and the resulting configurations of the pressure fields delimited thereby have the disadvantage that the compensation of the pressures acting on the pressing element from opposite axial sides leaves much to be desired. Another important disadvantage of this conventional construction is that, because of the pressure force distribution between or among the pressure fields, the gear machine is prone to malfunction, especially when operated with reverse pressure gradient.

SUMMARY OF THE INVENTION

Accordingly, it is a general object of the present invention to avoid the disadvantages of the prior art.

More particularly, it is an object of the invention to provide a reversible gear machine usable as a gear pump or a gear motor, which does not possess the disadvantages of the conventional gear machines of this type.

Still another object of the present invention is so to construct the gear machine and particularly the sealing component thereof as to improve the distribution of the pressures acting on the respective pressure fields of the pressing element and thus the sealing action of the latter.

It is yet another object of the present invention so to design the gear machine of the type here under consideration as to be operatable with equal efficiency regardless of the direction of the pressure gradient between the input and output sides of the gear machine.

A concomitant object of the present invention is to develop a machine of the above type which is simple in construction, inexpensive to manufacture, easy to use, and reliable in operation nevertheless.

In pursuance of these objects and others which will become apparent hereafter, one feature of the present invention resides in a reversible gear machine for use as a gear pump or a gear motor, such gear machine comprising housing means including a circumferential wall and two end walls together bounding an internal chamber and having two substantially aligned ports for admitting operating fluid into and discharging the same from the internal chamber at different pressures; two gears each having an external gear annulus centered on an axis and two oppositely facing end faces; means for so mounting the gears in the internal chamber for rotation about the respective axes that the gear teeth annuli mesh with one another at a meshing region situated between the ports, including two shafts each coaxially connected to one of the gears for rotation therewith and including two shaft portions each coaxially extending beyond one of the axial end faces, and means for defining respective openings for receiving the shaft portions, including at least one substantially plate-shaped pressing element arranged between one of the axial end faces of the gears and that of the end walls of the housing means which faces the one axial end face for axial movement toward and away from the one end face and having opposite end surfaces one of which faces the one end face and the other away from the one end face, the defining means rotatably supporting the shaft portions on the housing means; and means for urging the pressing element toward the one end face during the operation of the gear machine, including at least one substantially eyeglass-frame-shaped sealing component arranged at the other end surface of the pressing element and having a main portion spaced from the circumferential wall of the housing means and relatively large-area extensions at the diametrically opposite regions of the main portion that extend from the latter into contact with the circumferential wall, the sealing component delimiting on the other end surface of the pressing element first and second pressure fields respectively communicating with one and the other of the ports, and substantially annular, relatively narrow, third pressure fields disposed between the sealing component and the respective shaft portions and subjected to the same pressure as that prevailing at the one end surface of the pressing element between the root circles of the gear teeth annuli and the respective shaft portions. Advantageously, the sealing component is so partially accommodated in a groove provided either in the end wall or in the pressing element, and especially in the latter, that the sealing component extends out of the groove and contacts either the sealing element or the end wall, and especially the latter. In this manner, the various pressure fields are excellently separated from one another by the sealing component, and the pressure distribution among these pressure fields is as desired for both senses of rotation and for both pressure gradients between the ports.

A particularly advantageous construction of the gear machine according to the present invention is obtained when the pressing element includes two substantially sleeve-shaped bearing members, each having the opening for receiving and rotatably supporting one of the shaft portions of one of the two gears, the bearing members abutting one another and the circumferential wall of the housing means to support the respective shaft portions on the housing means. In this context, it is further advantageous when the bearing members have respective groove sections at the one end surface thereof, these groove sections together constituting the aforementioned groove which partially receives the sealing component such that the latter extends out of the groove into sealing contact with the end wall of the housing means which is closest to the sealing element.

According to a further advantageous concept of the present invention, the defining means further includes an additional pressing element similar to the above-discussed one sealing element and situated across the gears from the one sealing element. Then, there is further provided means for urging the additional pressing element toward the other end face of the gears during the operation of the gear machine, such urging means including an additional sealing component similar to the one sealing component and arranged between the latter and the other of the end walls of the housing means. The advantage of this construction is that the forces attributable to the various pressures of the operating fluid act symmetrically on the two pressing elements and via the same on the gears, so that the latter will not be subjected to any unbalanced forces.

A particularly advantageous construction of the sealing component is obtained when the latter includes a relatively rigid support ring, especially of a synthetic plastic material, arranged at a spacing from the sealing element, and an elastically yieldable sealing body, especially of an elastomeric material such as rubber, which is secured to the support ring and extends therefrom into sealing contact with the pressing element. In this context, it is especially advantageous when the support ring has a substantially U-shaped cross section and when the sealing body has a rib which extends toward the pressing element and contacts the bottom of the groove provided in the latter to subdivide such groove into two compartments. It is also advantageous when the extensions of the sealing component have substantially circular sector outlines.

The novel features which are considered as characteristic of the invention are set forth in particular in the appended claims. The improved gear machine itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENT

Figure 1:
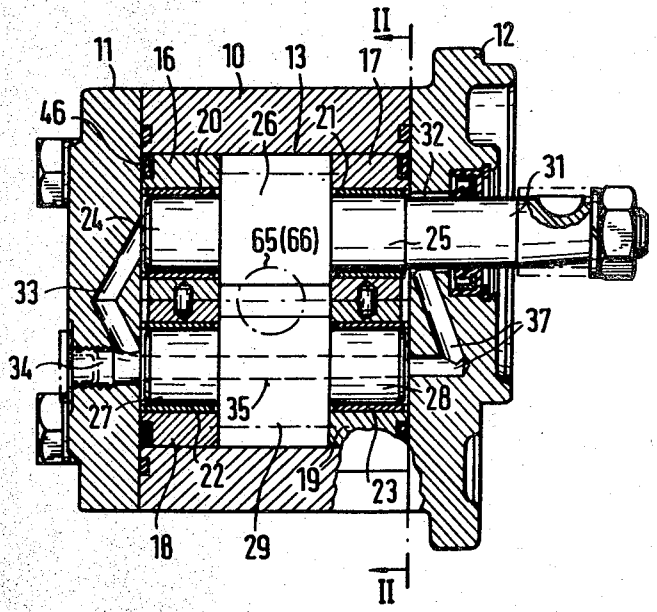
FIG. 1 is a longitudinal section through a gear machine constructed in accordance with the present invention.

Referring now to the drawing in detail, and first to FIG. 1 thereof, it may be seen that the reference numeral 10 has been used therein to identify a housing of a gear machine, that is, a gear pump or a gear motor. The housing 10 is closed at its ends by respective lids 11 and 12. The housing 10 circumferentially bounds an internal space 13 which is constituted by two intersecting substantially cylindrical bores 14 and 15 which intersect each other, so that the internal space 13 has the configuration of the numeral 8 in cross section.

Bearing members 16 to 19, which have the configurations of bushings, are arranged in pairs in the internal space 13. The bushing-shaped bearing members 16 to 19 have respective central openings 20 to 23 which are axially aligned with one another in respective pairs. Stub shafts 24 and 25 of a gear 26 with external teeth are supported in the associated bearing members 16 and 17, or more particularly in the central openings 20 and 21 of the latter. Similarly, stub shafts 27 and 28 of a gear 29 with external teeth are supported in the associated bearing members 18 and 19, or more particularly in the central openings 22 and 23 of the latter. The gear 29 is in external meshing engagement with the gear 26. The stub shaft 25 of the gear 26 continues in an axially aligned shaft extension 31 which passes through a bore 32 provided in the lid 12 to the exterior of the housing assembly constituted by the housing 10 and the lids 11 and 12. When the gear machine is to be used as a gear pump, the shaft extension 31 serves for driving the movable components of the gear machine, that is, primarily the gears 26 and 29. When the gear machine is to be used as a gear motor, then the meshing gears 26 and 29 drive the shaft extension 31 and the thus obtained torque is then delivered to equipment to be driven by the gear machine.

The regions of the ends of the openings 20 and 22 in the bearing members 16 and 18 which are closer to the lid 11 are connected with one another by means of a connecting channel 33 provided in the lid 11. The connecting channel 33 communicates with a port 34 also formed in the lid 11 and leading to the exterior of the housing assembly 10 to 12. The gear 29, together with its stub shafts 27 and 28, is penetrated by a through bore 35 which is also in communication with the port 34. A connecting channel 37 leads from the bore 32 of the lid 12 to the region of the end of the opening 23 of the bearing member 19 which is closer to the lid 12, the connecting channel 37 being formed in the lid 12. The connecting channels 33 and 37, the through bore 35 and the port 34 serve solely for the discharge of leakage fluid, especially oil. In other words, the regions of the ends of the central bores 20 to 23 and thus the end faces of the stub shafts 24, 25, 27 and 28 are pressure-relieved in that they are in communication with the port 34 which, in turn, is connected to a supply reservoir that is at ambient pressure.

Figure 11:
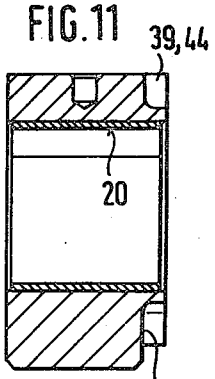
FIG. 11 is a cross-sectional view taken on line XI—XI of FIG. 10.
Figure 10:
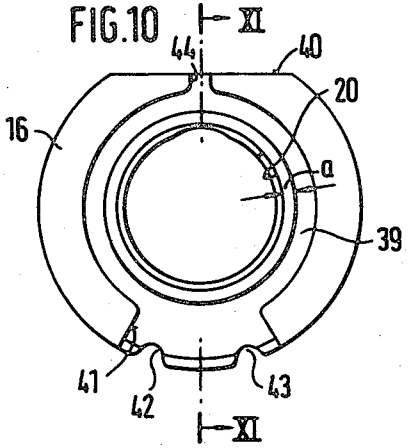
FIG. 10 is an end view of a bearing member used in the gear machine of FIGS. 1 and 2.

FIGS. 10 and 11 show in detail one of the bearing members 16 to 19, in the illustrated case, the bearing member 16. All of the bearing members 16 to 19 have the same construction and configuration, so that the following description of the bearing member 16 is equally applicable to the remaining bearing members 17 to 19. As shown in FIGS. 10 and 11, the bearing member 16 has, at the end face thereof which in the mounted position of FIGS. 1 and 2 faces the lid 11, an annular groove 39 which is situated at a small distance a from the central opening 20. The bearing member 16 has a flat face 40 which in the mounted position contacts the flat face 40 of the bearing member 18. Opposite to the flat face 40, the annular groove 39 merges into a substantially segment-shaped, relatively wide groove enlargement portion 41 which extends all the way to the outer periphery of the bearing member 16. At the region of the groove enlargement portion 41, there are also formed two elongated grooves 42 and 43 in the outer periphery of the bearing member 16. The elongated grooves 42 and 43 extend substantially in the axial direction of the bearing member 16 from one of the axial end faces of the latter to the other. The groove 39 further has, at its region that is close to the flat face 40, a relatively narrow exit portion 44 which extends all the way to the flat face 40.

Figure 9:
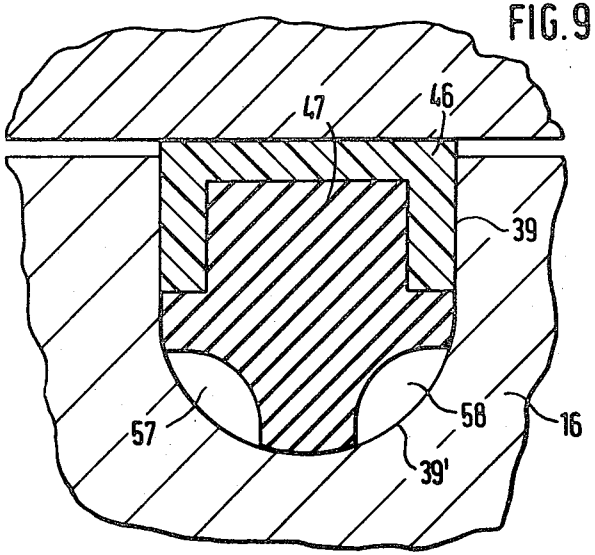
FIG. 9 is a detailed cross-sectional view showing the elements of FIGS. 4 to 8 in assembled condition and at a further enlarged scale.

The cross-sectional configuration of the groove 39 is depicted particularly in FIG. 9. The groove 39 has a substantially rectangular cross section with a rounded bottom portion 39'. As may also be seen in FIG. 9, a sealing component including a support ring 46, preferably of synthetic plastic material, and a sealing body 47, preferably of rubber or similar elastomeric material, is accommodated in the groove 39. The sealing component also has portions which extend into the groove enlargement portion 41 and into the groove exit portion 44. This may be best seen in FIGS. 3 and 4 which depict the support ring 46 in detail, and in FIGS. 5 to 8 which show the sealing body 47 in detail.

Figures 3, 4, 5, 6, 7, 8:
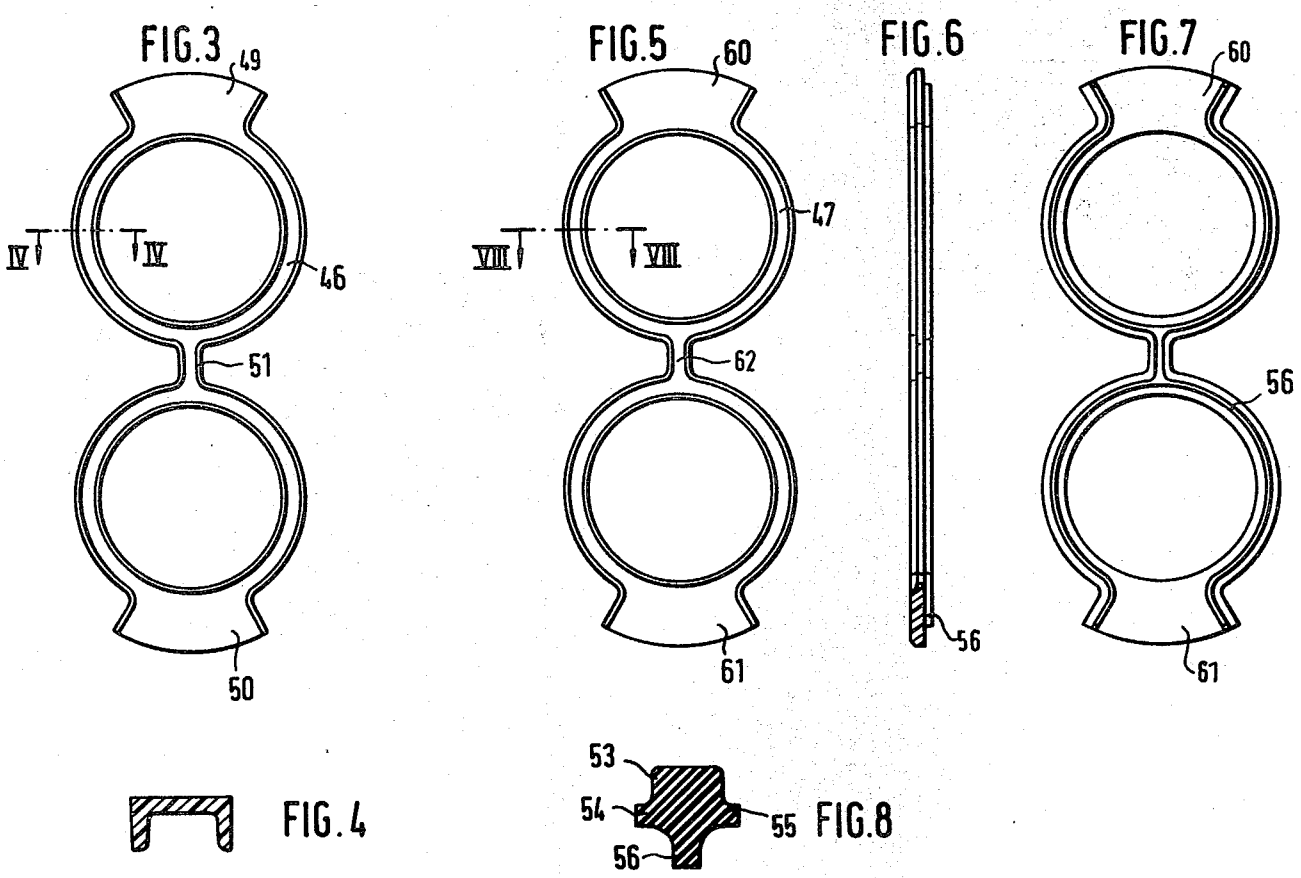
FIG. 3 is an end view of a support ring used in the gear machine of FIGS. 1 and 2.
FIG. 4 is a cross-sectional view taken on line IV—IV od FIG. 3, at an enlarged scale.
FIGS. 5 to 7 are front end, side, and rear end elevational views of a sealing body used with the support ring.
FIG. 8 is a cross-sectional view taken on line VIII—VIII of FIG. 5, at an enlarged scale.

As illustrated especially in FIG. 3, the support ring 46 has a shape reminiscent of that of an eyeglasses frame. The support ring 46 is provided, at its respective diametrically opposite regions, respective enlarged portions 49 and 50 of substantially sector-shaped configurations. The enlarged portions 49 and 50 are so configurated as to be substantially fittingly received in the groove enlargement portions 41 of the respective ones of the bearing members 16 to 19. The support ring 46 further includes two substantially circular portions which fit into the annular groove 39 and which are connected with one another by a bridge portion 51 which fits into the groove exit portions 44 of the respective bearing members 16 to 19 and extends across the interspace delimited by the respective flat faces 40 of the respective bearing members 16 to 19. As shown in FIG. 4, the support ring 46 is substantially U-shaped in cross section, so that it bounds a cross-sectionally U-shaped recess.

The sealing body 47 is partially accommodated in the U-shaped recess of the support ring 46. The sealing body 47 has substantially the same configuration, that is, it extends along substantially the same course, as the support ring 46, but has a different cross-sectional shape, as shown in FIG. 8. The sealing body 47 has, as considered in the cross section, a mounting zone 53 which is relatively wide and which is fittingly received in the U-shaped recess in the support ring 46. The sealing body 47 further includes, in its central zone, two transversely extending web portions 54 and 55. The distance between the free end faces of the web portions 54 and 55 substantially corresponds to the width of the support ring 46. Finally, a relatively narrow but relatively long zone 56 of the sealing body 47 adjoins the web portions 54 and 55 across from the mounting zone 53. As may be seen in FIG. 9, in the assembled or mounted position of the sealing component 46, 47, the zone 56 delimits in the groove 39 two channels 57 and 58 which are situated close to the curved bottom portion 39'. While the zone 56 is shown in FIG. 9 to separate the channels 57 and 58 from one another, it is to be mentioned at this juncture that, in the operating condition when the pressure of the pressurized fluid presses the sealing component including the sealing body 47 and the support ring 46 against the respective lid 11 or 12, the channels 57 and 58 are in communication with one another. Of course, the manner in which the sealing component 46, 47 is inserted into the groove 39 is determined by these conditions. More particularly, the sealing component 46, 47 is to be so introduced into the groove 39 that the sealing body 47 extends toward the bottom portion 39' of the groove 39, while the support ring 46 extends toward and abuts the respective lid 11 or 12 in the assembled condition of the gear machine. Similarly to the support ring 46 and the groove 39 with its zones 41 and 44, the sealing body 47 also has, as shown in FIG. 5, substantially sector-shaped enlarged portions 60 and 61 at its diametrically opposite regions. These enlarged portions 60 and 61 are respectively received in the U-shaped recesses 49 and 50 of the support ring 46, in a fitting manner. The sealing body 47 further includes a bridge portion 62 which is fittingly received in the bridge portion 51 of the support ring 46.

FIG. 6 show a partially sectioned side elevational view of the sealing body 46, the section being taken through the region of the enlarged portion 61. It may be seen from the comparison of FIGS. 6 and 7 that the sealing zone 56 extends substantially along respective radii at the region of the enlarged portion 61, and the same is valid about its course in the region of the enlarged portion 60.

Figure 2:
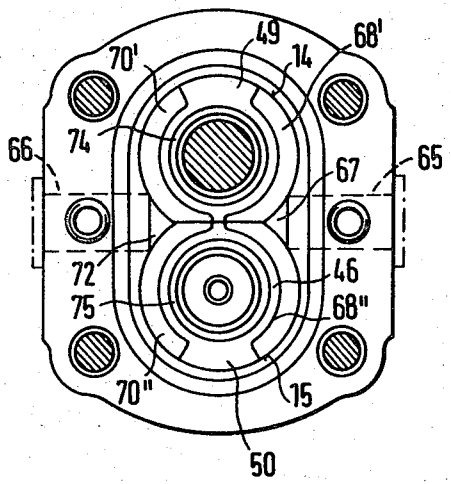
FIG. 2 is a cross-sectional view taken on line II—II of FIG. 1.

As depicted particularly in FIG. 2, but as also shown in FIG. 1 one above-discussed sealing component including the support ring 46 and the sealing body 47 is inserted into the grooves 39 of the bearing members 16 and 18, on the one hand, and another such sealing component 46, 47 is introduced into the grooves 39 of the bearing members 17 and 19. Inasmuch as these two sealing components are identical in construction and configuration, they have been identified by the same reference numerals.

As is conventional in the construction of gear machines, two ports 65 and 66 which extend substantially along the same axis but which are arranged at opposite sides of the housing 10 penetrate through the housing 10 and communicate with the internal space 13 of the latter. These ports 65 and 66 open into the regions of meshing of the gears 26 and 29 with one another and serve for the supply and discharge of the operating fluid.

Having so described the construction of the machine of the present invention, the operation thereof will now be explained for the case that the gear machine is being used as a gear motor. In this case, operating fluid at high pressure is supplied to the port 65. The operating fluid then proceeds along the outer peripheries of the gears 26 and 29 to the port 66 which serves as a discharge port under these circumstances, thus causing the gears 26 and 29 to rotate about their respective axes in opposite senses and in meshing engagement with one another. The high-pressure operating fluid simultaneously penetrates, through a substantially triangular nip zone 67 which is bounded in the internal space 13 of the housing 10 by the bearing members 16 to 19 and which extends over the entire axial dimension of the internal space 13, into the gap which exists between the bearing members 16 to 19 and the respective lids 11 and 12. In this gap, there is thus built up a first pressure field 68′ and 68″ at the high-pressure side, being delimited by the support ring 46 and the end faces of the bearing members 16 to 19. Another pressure field, which is coextensive with the support ring 46 and thus exactly corresponds in shape and area to the axial end face of the latter, being situated adjacent to such end face, is also simultaneously formed. This other pressure field is formed between the grooves 39, 41 and 44 provided in the bearing members 16 to 19 and the support ring 46. This other pressure field is also at the pressure of the high-pressure fluid, through the elongated grooves 42 and 43 provided at the outer peripheries of the bearing members 16 to 19. The pressure of the high-pressure fluid thus presses the support rings 46, together with the sealing bodies 47 mounted thereon, against the respective lids 11 and 12.

As shown in FIG. 2, additional pressure fields 70′ and 70″ are also formed in the aforementioned gap between the end faces of the bearing members 16 to 19 and the lids 11 and 12, these additional pressure fields being situated across the support ring 46 from the pressure fields 68′ and 68″. The pressure prevailing in the discharge port 66 is effective at these additional pressure fields 70′ and 70″, inasmuch as the latter are in communication, through a substantially triangular nip 72 defined in the internal space 13 of the housing 10 by the bearing members 16 to 19, with the discharge port 66. The discharge pressure can be very low, but it can also be relatively high in the event that, for instance, an additional gear motor is connected to the discharge port 66.

Auxiliary pressure fields 74 and 75 are formed in the annular spaces between the support ring 46 and the central openings 20 to 23 of the bearing members 16 to 19, as also indicated in FIG. 2. The pressure acting on these pressure fields 74 and 75 always corresponds to that prevailing in the channel 33 and the port 34 containing the leakage fluid. This pressure amounts to 5 to 8 bar maximum. The bearing members 16 to 19 are brought into sealing contact with the associated axially facing surfaces of the respective gears 26 and 29 as a result of the pressures exerted on the pressure fields by the operating fluid. The force to be compensated by the pressure acting on the annular pressure fields 74 and 75 is obtained by multiplying the area of the axial surface of the respective gear 29 or 26 which is substantially delimited by the root circle of the teeth of the gear 29 or 26 and the diameter of the respective central openings 20 to 23 by the pressure of the leakage fluid effective thereat.

The above-discussed gear machine is reversible, that is, the high-pressure fluid can also be supplied to the port 66. In this case, the port 65 becomes the discharge port. The high-pressure fields under these circumstances develop at 70 and 71 and again at the end face of the support ring 46, while the low-pressure fields develop at 68 and 69. The operation of the gear machine, however, is the same as described above, except for the sense of rotation, which is reversed. Moreover, the gear machine can be used as a pump without change of operating conditions prevailing in the interior of the housing 10, the only difference from the above-discussed situation being that torque is externally supplied to, rather than derived from, the shaft extension 31, and the high-pressure port 65 or 66 discharges, rather than receives, the high-pressure fluid.

It is, of course, possible to arrange pressure-subjected bearing members, such as 17 and 19, only on one axial side of the gears 26 and 29, while the other bearing members, such as 16 and 18, are not subjected to pressure and firmly abut the respective lid, such as 11. It is further possible to mount the stub shafts 24, 25, 27 and 28 directly in the housing arrangement 10 to 12, that is, to dispense with the separate bearing members 20 to 23. In this case, a flat sealing plate is arranged in the internal space 13 of the housing arrangement 10 to 12, this sealing plate being then provided, in the manner described above, with the sealing arrangement 46, 47 which is pressed by the operating fluid pressure against the respective axial end face of the respective gears 26 and 29. Of course, one of such sealing plates can be provided at each of the axial sides of the gears 26 and 29.

The gear machine according to the present invention can be used in a four-quadrant operation, that is, either as a gear pump or as a gear motor, and with pressure drop between the ports 65 and 66 is either direction. What is important in connection with the gear machine according to the present invention is that it can also be subjected to elevated pressure at its low-pressure side, that is, superatmospheric pressure may also prevail at the outlet port 65 or 66 of the machine, for instance, when the latter is used as a gear motor. This is particularly advantageous when the outlet port 65 or 66 is connected to the inlet port of another gear motor to which there is then supplied the operating fluid at the discharge pressure of the first gear motor for operating the second gear motor.

Figure 12:
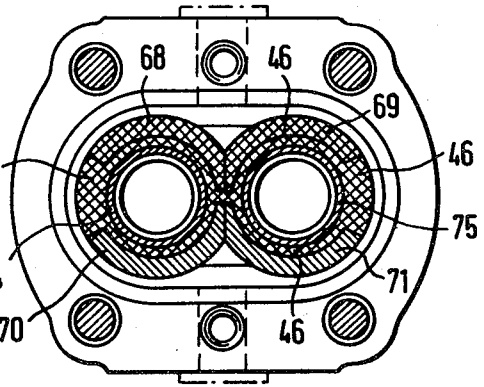
FIG. 12 is a schematic representation of pressure fields.

The diagrammatic representation of FIG. 12 shows clearly the positions of the various pressure fields relative to one another. Herein, the fields 68 and 69 and the end face of the sealing ring 46, all of which are crisscross hatched, are subjected to the same pressure (high pressure), the pressure fields 70 and 71, which are hatched from left above to right below, are subjected to the discharge or low pressure, and the annular areas 74 and 75, which are hatched from rigth above to left below, are subjected to the pressure of the leakage fluid.

It will be understood that each of the elements described above, or two or more together, may also find a useful application in other types of arrangements differing from the type described above.

While the invention has been illustrated and described in detail as embodied in a gear machine used as a gear motor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptation should and are intended to be comprehended within the meaning and range of equivalence of the claims.

What is claimed as new and desired to be protected by Letters Patent is set forth in the appended claims.

We claim:

1. A reversible gear machine for use as a gear pump or a gear motor, comprising housing means including a circumferential wall and two end walls together bounding an internal chamber and having two substantially aligned ports for admitting operating fluid into and discharging the same from said internal chamber at different pressures; two gears each having an external gear annulus centered on an axis and two oppositely facing axial end faces; means for so mounting said gears in said internal chamber for rotation about the respective axes that said gear teeth annuli mesh with one another at a meshing region situated between said ports, including two shafts each coaxially connected to one of said gears for rotation therewith and including two shaft portions each coaxially extending beyond one of said axial end faces, and means for defining respective opening for receiving said shaft portions, including at least one substantially plate-shaped pressing element arranged between one of said axial end faces of said gears and that of said end walls of said housing means which faces said one axial end face for axial movement toward and away from said one end face and having opposite end surfaces one of which faces said one end face and the other away from said one end face, said defining means rotatably supporting said shaft portions on said housing means; and means for urging said pressing element toward said one end face during the operation of the gear machine, including at least one substantially eyeglassframe-shaped sealing component arranged at said other end surface of said pressing element and having a main portion spaced from said circumferential wall of said housing means and relatively large-area extensions at the diametrically opposite regions of said main portion that extend from the latter into contact with said circumferential wall, said sealing component delimiting on said other end surface of said pressing element first and second pressure fields respectively communicating with one and the other of said ports, and substantially annular, relatively narrow, third pressure fields disposed between said sealing component and the respective shaft portions and subjected to the same pressure as that prevailing at said one end surface of said pressing element between the root circles of said gear teeth annuli and the respective shaft portions for assisting in displacing said pressing elements into sealing contact with the respective end faces of said gears during the operation of said gear machine so as to avoid excessive leakage of said operating fluid between first and second pressure fields.

2. The gear machine as defined in claim 1, and further comprising means for bounding in one of the pressing element and the respective end wall closest to the latter a groove so configurated as to fittingly receive said sealing component with the latter extending out of said groove into sealing contact with the other of said respective end wall and the pressing element.

3. The gear machine as defined in claim 2, wherein said groove is provided in said pressing element.

4. The gear machine as defined in claim 1, wherein said pressing element includes two substantially sleeve-shaped bearing members, each having said opening for receiving and rotatably supporting one of said shaft portions of one of said gears, said bearing members abutting one another.

5. The gear machine as defined in claim 4, wherein said bearing members have respective groove sections at said one end surface thereof, said groove sections together constituting a groove for fittingly receiving said sealing component with the latter extending out of said groove into sealing contact with the respective end wall closest to said bearing members.

6. The gear machine as defined in claim 1, wherein said defining means further includes an additional pressing element similar to said one pressing element and situated across said gears therefrom; and further comprising means for urging said additional pressing element toward said other end face of said gears during the operation of the gear machine, including an additional sealing component similar to said one sealing component and arranged between the latter and the other of said end walls of said housing.

7. The gear machine as defined in claim 1, wherein said sealing component includes a relatively rigid support ring arranged at a spacing from said pressing element and an elastically yieldable sealing body secured to said support ring and extending therefrom into sealing contact with said pressing element.

8. The gear machine as defined in claim 7, wherein said support ring is of a synthetic plastic material.

9. The gear machine as defined in claim 7, wherein said sealing body is of rubber.

10. The gear machine as defined in claim 7, wherein said pressing element has a groove partially receiving said sealing component and having a bottom; wherein said support ring has a substantially U-shaped cross section; and wherein said sealing body has a rib which extends toward the pressing element and contacts the bottom of said groove to subdivide the latter into two compartments.

11. The gear machine as defined in claim 1, wherein said extensions of said sealing component have substantially circular sector outlines.

12. The gear machine as defined in claim 1, and further comprising means for bounding in one of the pressing element and the respective end wall closest to the latter a groove so configurated as to fittingly receive said sealing component with the latter extending out of said groove into sealing contact with the other of said respective end wall and the pressing element, said groove being provided in said pressing element and spaced from said shaft so as to define said third pressure field disposed between said shaft and said sealing component received in said groove.

* * * * *